United States Patent [19]

Whittington et al.

[11] Patent Number: 4,817,900

[45] Date of Patent: Apr. 4, 1989

[54] SUPPORT DEVICE FOR USE ON A DISPLAY WALL

[75] Inventors: Paul S. Whittington, Thornhill; James Morison, Oshawa, both of Canada

[73] Assignee: Gorrie Advertising Management Limited, Ontario, Canada

[21] Appl. No.: 191,537

[22] Filed: May 9, 1988

[51] Int. Cl.[4] ..... F16B 5/06

[52] U.S. Cl. ..... 248/225.1; 211/88; 211/175; 248/223.4; 248/224.4; 248/201

[58] Field of Search ..... 248/225.1, 227, 235, 248/239, 250, 201, 220.2, 223.4, 224.4; 211/175, 87, 59.2, 55, 88, 184; 108/109, 152

[56] References Cited

U.S. PATENT DOCUMENTS

| | | | |
|---|---|---|---|
| 268,309 | 3/1883 | Wall . | |
| 268,313 | 3/1883 | Ryman . | |
| 281,040 | 10/1885 | Campbell . | |
| 286,742 | 11/1886 | Gohrig . | |
| 2,940,603 | 6/1960 | Riedmaier et al. | 248/250 |
| 3,129,819 | 4/1964 | Chandler . | |
| 3,185,426 | 5/1965 | Bjerke | 248/250 |
| 4,094,416 | 6/1978 | Smith . | |
| 4,269,317 | 5/1981 | Rubenstein . | |
| 4,429,850 | 2/1984 | Weber et al. | 248/250 |
| 4,592,471 | 6/1986 | Bross | 211/184 X |
| 4,615,448 | 10/1986 | Johnstonbaugh . | |
| 4,712,694 | 12/1987 | Breslow | 211/184 |
| 4,718,132 | 1/1988 | Wirland | 108/152 X |

*Primary Examiner*—Ramon O. Ramirez
*Attorney, Agent, or Firm*—Nixon & Vanderhye

[57] ABSTRACT

A support device is disclosed for supporting a product on a display wall having a number of regularly spaced passages. The device has a body to support the product, a pair of elements for releasable attachment of the body to the display wall, including a first element for disposition in a first of the passages. The first element is arranged to inhibit removal thereof from the first passage when the body is in an operative position. A second element is provided for disposition in a second of the passages whereby, in the operative position, the second element is biased toward engagement with an edge portion of the display wall defining the second passage so as to inhibit displacement of the second element from the operative position. There is also disclosed a support device for supporting a product on a display wall, comprising a body to receive the product and an attachment means to attach the body on the display wall. The body has a base with a first end portion for disposition remote form the display wall and a second end portion for disposition adjacent the display wall, first and second support elements outwardly extending from the first and second end portions respectively, an intermediate support element arranged to extend outwardly from the base between the first and second support elements so as to define a pair of regions between the first, intermediate and second support elements.

11 Claims, 5 Drawing Sheets

SUPPORT DEVICE FOR USE ON A DISPLAY WALL

The present invention relates to product support assemblies and, particularly, to those used with slotted background panels to display retail merchandise.

Panels of this type are commonly used with metal brackets which have an upwardly bent flange hooking into any one of the slots. These brackets extend outwardly from the panel to support, for example, clothing hangers. In another application, the brackets support a shelf which displays a product in its unpackaged, fully assembled form, while the packaged product for purchase is stored elsewhere.

Although satisfactory for their intended purpose, conventional product support assemblies have several shortcomings. Firstly, since the bracket is held only by a single upwardly bent flange, there is a risk that inadvertent contact with the bracket by any passing object will cause the bracket either to be released from the wall or cause the products themselves to fall from the display.

Secondly, the conventional shelf arrangement typically requires an excessive use of space, since the unpackaged product and the packaged product are necessarily stored in separate locations on the premises. This not only leads to complications in inventory control, but also requires that the retail personnel assist the purchaser in locating the packaged product, thereby reducing the efficiency of the premises and leading to further expense.

It is therefore an object of the present invention to obviate or mitigate the above-mentioned disadvantages.

Briefly stated, the invention comprises a support device for supporting a product on a display wall having a number of regularly spaced passages, comprising a body to support said product, attachment means for releasable attachment of said body to said display wall, said attachment means including a first element for disposition in a first of said passages, said first element being arranged to inhibit removal thereof from said first passage when said body is in an operative position and a second element for disposition in a second of said passages whereby, in said operative position, said second element is biased toward engagement with an edge portion of said display wall defining said second passage so as to inhibit displacement of said second element from said operative position.

In another aspect of the present invention there is provided a support device for supporting a product on a display wall, comprising a body to receive said product and attachment means to attach said body on said display wall, said body having a base with a first end portion for disposition remote from said display wall and a second end portion for disposition adjacent said display wall, first and second support elements outwardly extending from said first and second end portions respectively, an intermediate support element arranged to extend outwardly from said base between said first and second support elements so as to define a pair of regions between said first, intermediate and second support elements in which said product is to be supported.

By providing an intermediate wall in the above manner, two sections are defined on the support allowing the product to be arranged in several alternative arrangements, enabling the product to be displayed while at the same time making efficient use of the space on the display wall.

In a preferred embodiment, the intermediate wall is movable along the base, which permits the number of stock items to be housed in the front section to be varied according to sales volume, while presenting an appearance across the display of a full stock.

In another preferred embodiment, the intermediate wall may be removed from the base, in order to provide optional use of the intermediate wall.

A preferred embodiment of the present invention will now by described by way of example only as illustrated in the appended drawings in which.

Referring now to the FIGS. 1 to 4, a display arrangement is illustrated at 10 wherein a pair of left and right support elements 12, 14 are attached to a display wall 16 having a number of regularly spaced undercut slots 18.

Figure 1:
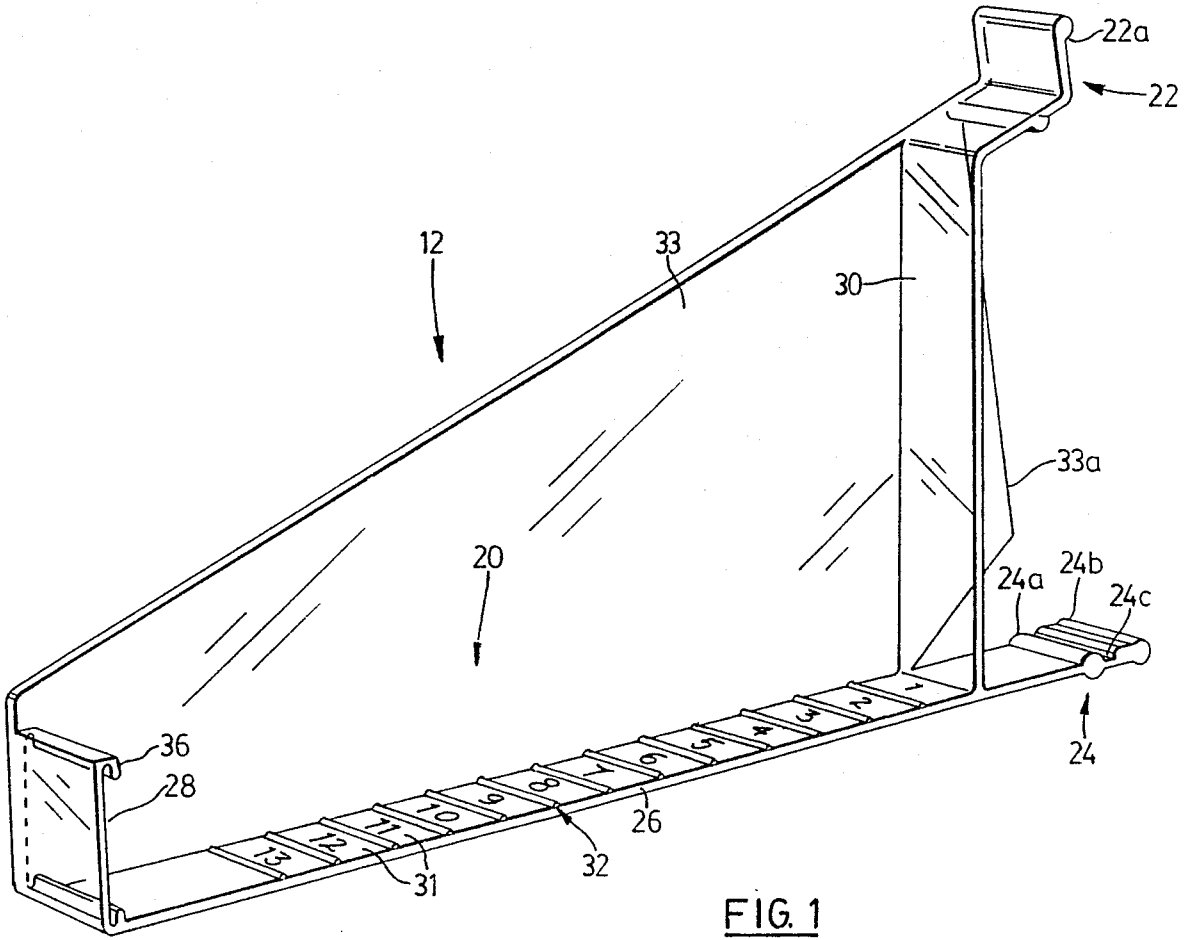
FIG. 1 is a perspective view of a support element.

The left support element 12 is illustrated in FIG. 1, although it is to be understood that the right support element has an identical but allochiral construction. The right support element 12 has a body 20 formed from transparent plastics material so as to maximize the exposure of the product in the display. The body has upper and lower mounting flanges 22, 24 which engage respectively upper and lower slots identified at 18*a* and 18*b* formed in the display wall 16. A base wall 26 is provided to support the product and terminates at a front wall 28 and a rear wall 30. The base wall is subdivided into a series of zones 31, which are consecutively numbered for convenience and separated by ridges 32, to assist in retaining the products to be supported in an upright position. The bottom front and rear walls 26, 28, 30 respectively lie against a side wall 33 which extends beyond the rear wall 30 to an edge 33*a* which contacts the display wall 16 upon assembly as will be described.

The upper flange 22 has an upwardly extending abutment portion 22*a* which abuts an inner face of the undercut slot 18. The lower flange 24 has an upper face having a pair of ridges 24*a*, 24*b* defining therebetween a groove in which the lip identified at 18*a* is inserted upon attachment.

The front wall is also provided with a pair of opposed spaced flanges 36 extending from its rearward face to allow product description, pricing and code identification.

In use, the support elements 12 14 are aligned against the display wall and separated from each other at a distance corresponding to the horizontal dimension of the product to be supported. Each of the support elements is upwardly oriented so that the abutment portion 22*a* may be inserted into the undercut slot 18. The assembly is then rotated downwardly until the remote edge of the lower flange 24 abuts the peripheral lip 18*a*. Increased downward force against the assembly causes the lower flange to flex resulting in the ridge 24*b* passing beneath the lip 18*a* until the lip rests in the groove 24*c*. In this position, the edge 32*a* contacts the display wall and thus provides an abutment surface to inhibit further downward displacement of the bracket.

Figure 2:
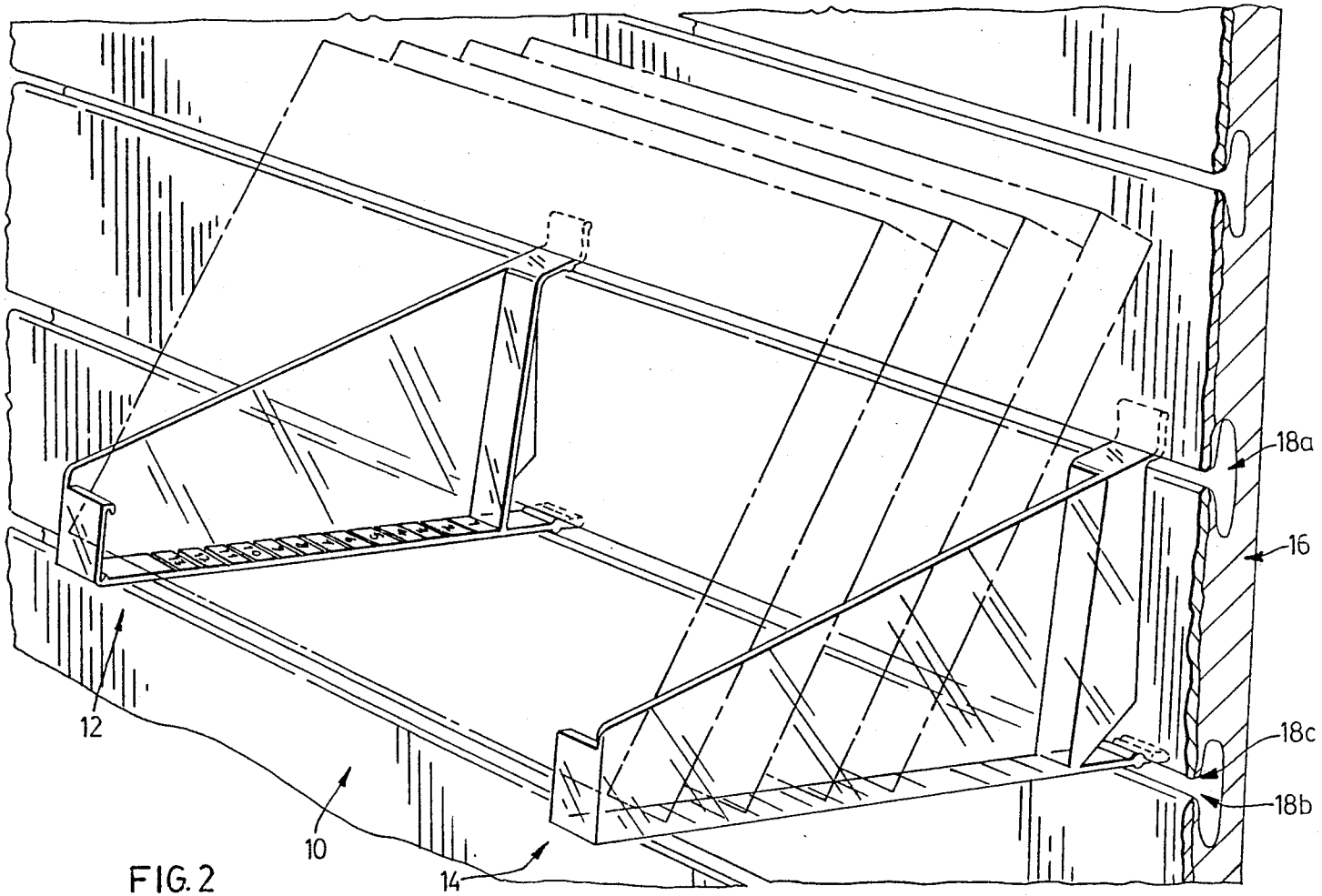
FIG. 2 is a perspective view of a retail display using the support element illustrated in FIG. 1.

The product may then be loosely disposed on the base wall 26 as illustrated in chain dot lines in FIG. 2. When the frontmost of the products is removed from the display, the ridges 32 assist in maintaining the remaining product in position.

Figure 3:
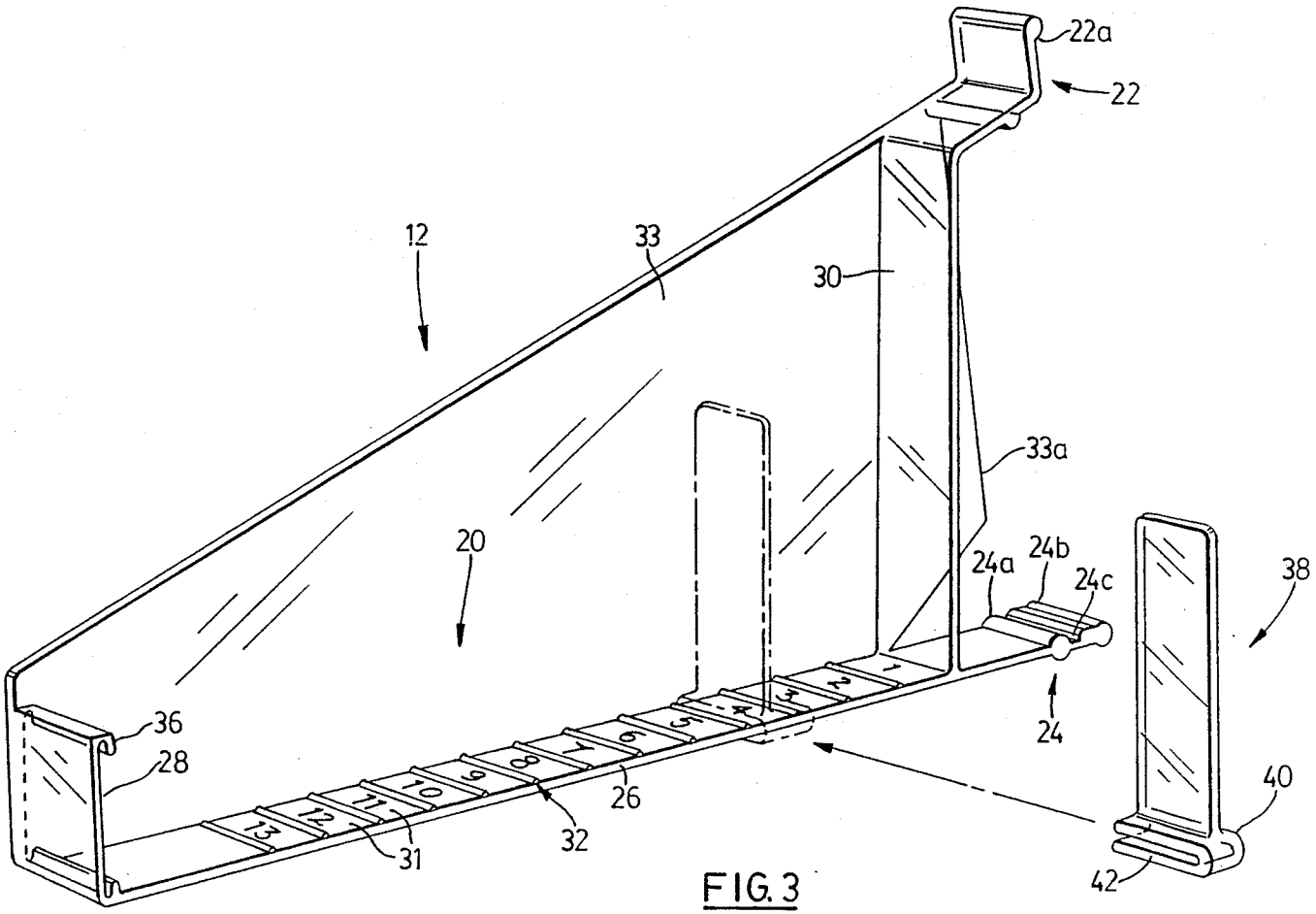
FIG. 3 is a perspective view of another support element.

An alternative arrangement is illustrated in FIG. 3 wherein an intermediate wall 38 is provided between the front wall 28 and the rear wall 30. The intermediate wall is movable along the base by way of a mount including a pair of flanges 40, 42 which engage respectively the opposite faces of the base wall 26.

Figure 4:
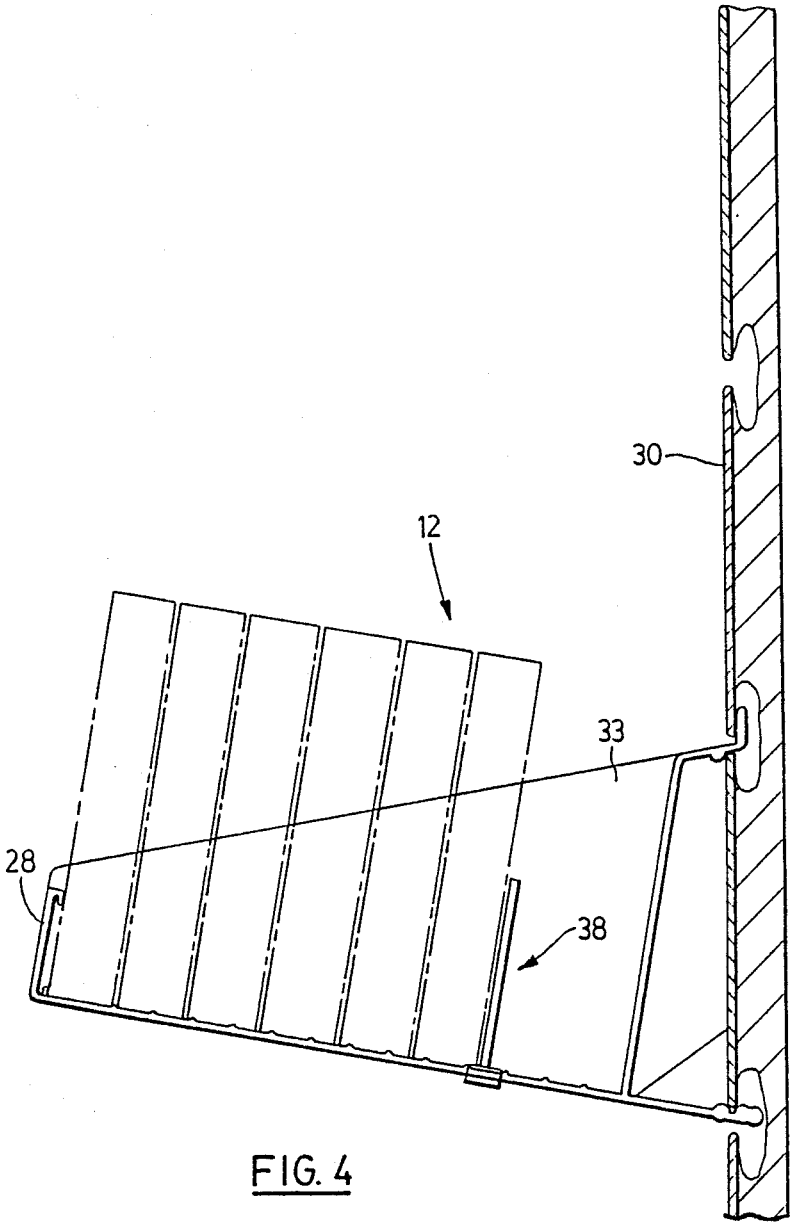
FIG. 4 is a sectional view of a retail display of the type illustrated in FIG. 2 including the support element of FIG. 3.

The movable wall 38 may be adjusted depending on the manner in which the product is to be stored. One possible arrangement is shown in FIG. 4 wherein the product is held tightly in the front section so that the product lies flush against the front wall. In another arrangement, the product may be disposed in the front section of the base wall with sufficient space between the front and intermediate wall to allow the product to tumble back onto the intermediate wall, in a similar fashion to the arrangement in FIG. 2.

Figure 5:
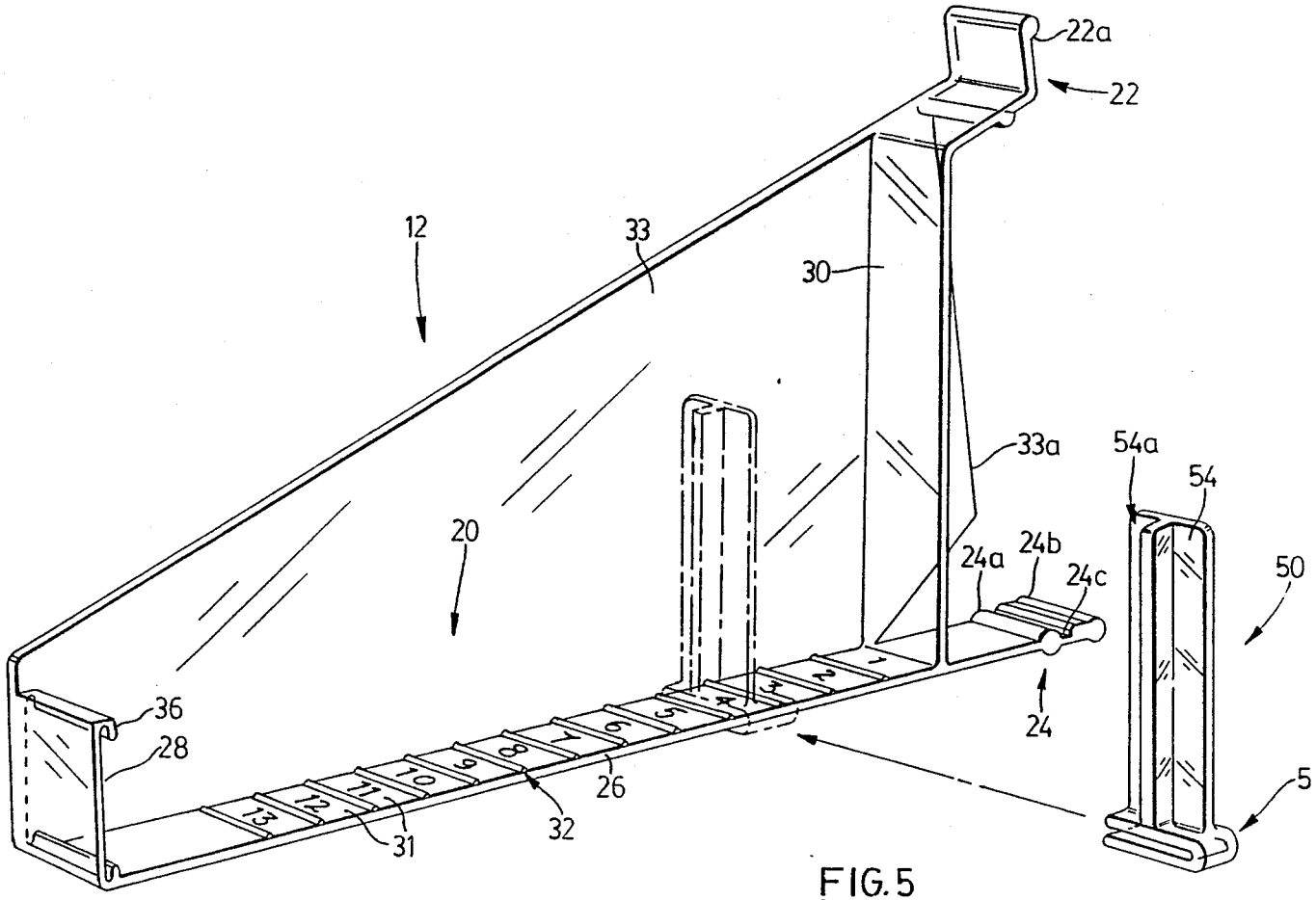
FIG. 5 is a perspective assembly view of still another support element.

An alternative embodiment to that illustrated in FIG. 3 is shown in FIG. 5, wherein the movable wall 50 has a mount 52, a face 54 and a reinforcement web **54*a* extending outwardly from the face 54. The reinforcement web provides an increased rigidity to the movable wall 50, which is particularly useful in supporting relatively heavy articles. Of course, the reinforcement web may extend from either the front surface of the movable wall 50**, or for that matter, from both of the surfaces.

It is to be understood that a number of alternatives are contemplated for the above arrangement, including the substitution of the transparent plastic material by a metal material or other opaque plastic materials. In addition, the support elements are equally usable on other display walls having a number of regularly spaced passages to receive the mounting flanges which would be dimensioned to engage the passages. As well, the intermediate wall may be mounted in fixed relation to the base. This may be done either by mounting the intermediate wall directly to the base or, for that matter to the side wall of the bracket if desired. In addition, the intermediate wall may be movably mounted to a suitably arranged side wall, instead of the base as described hereinabove, for example by way of a slot or a pair of opposed flanges in the side wall.

I claim:

1. A support device for supporting a product on a display wall having a number of regularly spaced passages, comprising a body to support said product, attachment means for releasable attachment of said body to said display wall, said attachment means including a first element for disposition in a first of said passages, said first element being arranged to inhibit removal thereof from said first passage when said body is in an operative position and a second element for disposition in a second of said passages whereby, in said operative position, said second element is spring biased toward engagement with an edge portion of said display wall defining said second passage so as to inhibit displacement of said second element from said operative position.

2. A support device as defined in claim 1 wherein said first and second elements are respectively defined by a pair of flanges outwardly extending from an abutment surface defined on said body and spaced from one another a distance corresponding to the spacing between said first and second passages.

3. A support device as defined in claim 1 wherein said passages are in the form of slots, said second element having a contoured surface which is complementary with said edge portion.

4. A support device as defined in claim 3 wherein said contoured surface includes a pair of transverse ridges.

5. A support device for supporting a product on a display wall, comprising a body to receive said product and attachment means to attach said body on said display wall, said body having a base with a first end portion for disposition remote from said display wall and a second end portion for disposition adjacent said display wall, first and second support elements outwardly extending from said first and second end portions respectively, an intermediate support element arranged to extend outwardly from said base between said first and second support elements so as to define a pair if regions between said first, intermediate and second support elements in which said product is to be supported.

6. A support device as defined in claim 5 wherein said intermediate support element is movable relative to said base to vary the relative dimensions of said regions.

7. A support device as defined in claim 5 wherein said first, intermediate and second support elements are defined by a first, intermediate and second wall portions respectively.

8. A support device as defined in claim 7 wherein said base is defined by a wall element having a pair of opposed faces, said intermediate wall portion being movable along said wall element by way of a pair of flanges, each of which is slidably engaged with a respective one of said faces.

9. A support device as defined in claim 8 wherein said wall element has a plurality of transverse ridges spaced therealong, said flanges being dimensioned to pass between said ridges.

10. A support device as defined in claim 7 wherein said first wall portion has a pair of opposed spaced guide elements outwardly extending therefrom to receive a display card.

11. A support device as defined in claim 8, wherein said intermediate wall portion includes at least one upright face, with a upright support web outwardly extending therefrom to enhance the rigidity of said intermediate wall portion.

* * * * *